United States Patent [19]

Wolfert

[11] Patent Number: 4,791,389

[45] Date of Patent: Dec. 13, 1988

[54] MILLIMETER WAVE CIRCULATOR

[75] Inventor: Paul H. Wolfert, Portola Valley, Calif.

[73] Assignee: Varian Associates, Inc., Palo Alto, Calif.

[21] Appl. No.: 54,717

[22] Filed: May 27, 1987

[51] Int. Cl.[4] ..... H01P 1/39

[52] U.S. Cl. ..... 333/1.1; 333/24.1

[58] Field of Search ..... 333/1.1, 24.1, 24.2

[56] References Cited

U.S. PATENT DOCUMENTS

| | | | |
|---|---|---|---|
| 3,341,789 | 9/1967 | Goodman et al. | 333/1.1 |
| 3,662,291 | 5/1972 | Cotter . | |
| 4,145,672 | 3/1979 | Piotrowski . | |
| 4,254,384 | 3/1981 | Piotrowski et al. . | |
| 4,638,267 | 1/1987 | Holpp . | |

FOREIGN PATENT DOCUMENTS

| | | | |
|---|---|---|---|
| 105403 | 8/1980 | Japan | 333/1.1 |
| 684654 | 9/1979 | U.S.S.R. | 333/1.1 |

OTHER PUBLICATIONS

U.S. Government Contract No. F33615-77-C-1120, Entitled "Millimeter Wave Device Development", by W. Piotrowski, K. Louie, M. Mlinar, R. Ebert, S. Schell and C. Sun, Dated Nov. 1981, Report No. AFWAL--TR-81-1199.

*Primary Examiner*—Paul Gensler

*Attorney, Agent, or Firm*—Stanley Z. Cole; John C. Yakes

[57] ABSTRACT

A millimeter wave wideband circulator which employs a triangular ferrite prism with symmetrically grooved sides. The prism is configured to support a pair of closely-spaced higher order resonance mode sets which function to enlarge the bandwidth of the circulator and to suppress spurious mode resonances in the center and roll-off portions of the bandpass. The simplicity of the junction design combined with the non-critical alignment requirement of the ferrite prism makes practical the fabrication of a multi-junction millimeter wave circulator in a single integrated housing.

17 Claims, 3 Drawing Sheets

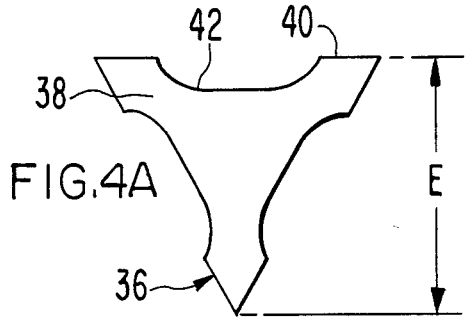
FIG.4A
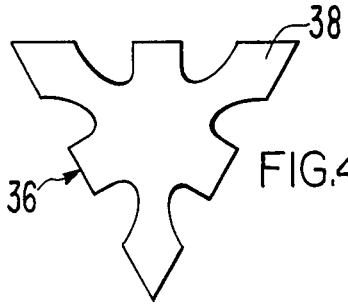
FIG.4B
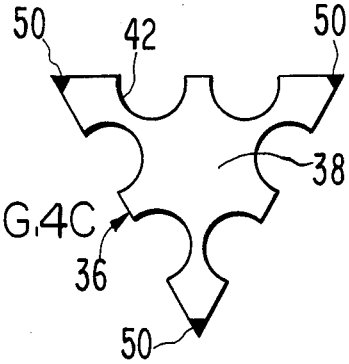
FIG.4C
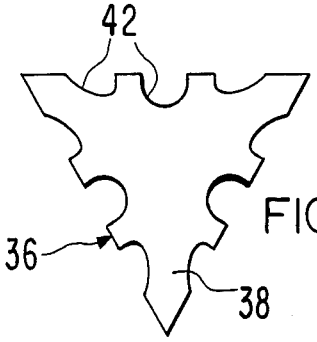
FIG.4D
FIG.5
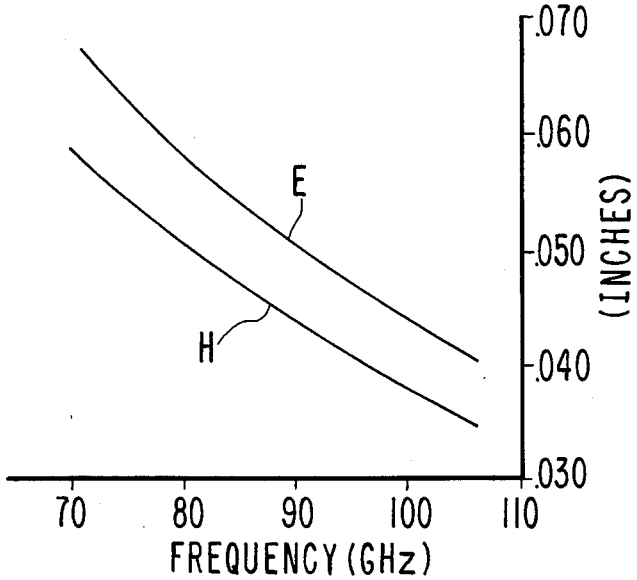

MILLIMETER WAVE CIRCULATOR

The U.S. Government has rights in this invention pursuant to Contract No. N66001-84-C-0279 between the Naval Ocean Systems Center and Varian Associates, Inc.

BACKGROUND OF THE INVENTION

I. Field of the Invention

This invention relates generally to microwave devices and in particular to wide band ferrite circulators suitable for use at millimeter wave frequencies. Such circulators have many applications including their use as isolators, switches, and as components in reflection-type amplifiers.

II. Description of the Prior Art

Microwave signals with wave lengths shorter than about 1 cm are conventionally referred to as millimeter waves. High performance ferrite circulators intended for use at frequencies below 30 GHz are well known in the prior art. The present invention is generally concerned with ferrite circulators intended for operation between about 40 GHz and 300 GHz and particularly with ferrite circulators intended for operation within the frequency range extending from 75 to 110 GHz, which is commonly referred to as the W-band.

The geometry and dimensions of one or more ferrite elements is the principal factor which determines circulator performance. The way in which the ferrite element is embedded in a waveguide Y-junction is a secondary performance consideration. Ferrite elements dimensioned for fundamental mode operation in the W-band exhibit bandwidths typically from about 1 to 2%.

In an effort to achieve broader bandwidth, ferrite elements have been configured and dimensioned to function at higher order modes. More particularly, a pair of closely-spaced higher order resonant mode sets are used to enable the ferrite element to exhibit the familiar double-ripple response over the broader bandwidth. A detailed discussion of technical factors concerning the design of millimeter wave circulators may be found in U.S. Air Force Technical Report No. AFWAL-TR-81-1199 entitled: "Millimeter Wave Device Development", the disclosure of which is incorporated by reference herein. U.S. Pat. No. 4,638,267 to Holpp provides another example of the well known use of a pair closely-spaced higher order resonant mode sets to enlarge the bandwidth of a ferrite circulator.

When broad band circulators are designed for higher order mode operation above 40 GHz, the suppression of spurious mode resonances becomes a significant problem. Spurious modes cause spike-type disturbances of the return loss and insertion loss functions. In amplifier applications, spurious modes cause irregular gain functions and potential instabilities.

Most W-band circulator designs known in the prior art present significant manufacturing problems because the various junction components must be manufactured to close tolerances and then assembled with precise alignment. The complexity of these prior art junctions typically requires each junction to be individually tested and tuned after assembly. This requirement of individual testing precludes construction of circulators which employ multiple junctions in a single housing.

SUMMARY OF THE INVENTION

The present invention overcomes many of the shortcomings associated with ferrite circulators intended for use at frequencies above 40 GHz and in particular, in the W-band. It does so by employing a single ferrite element of novel configuration which may be embedded in an H-plane waveguide Y-junction to form a circulator. Unlike prior art circulators, the alignment of the ferrite element in the junction is not critical and junctions made in accordance with the invention typically do not require individual tuning after assembly. Because of its design simplicity, the present invention is particularly well-suited for use in multi-junction circulators.

For example, the invention has been used to construct a four-stage, reflection-type amplifier, which posseses a bandwidth of about 10 GHz and is designed for operation around 92 GHz. This amplifier employs a circulator with 9 junctions, all of which are arranged and interconnected in a single compact housing. This housing can be economically mass-produced with conventional, numerically-controlled milling equipment. Such constructions have heretofore been impossible because of the requirement to individually test and adjust each junction during assembly.

Accordingly, an object of the present invention is to provide a millimeter wave circulator which can overcome the shortcomings discussed above which are associated with such circulators known in the prior art.

Another object of the present invention is to provide a millimeter wave circulator of simple design which is economical to manufacture.

A further object of the invention is to provide a ferrite prism suitable for use in a broad band Y-junction millimeter wave circulator wherein the prism possesses a pair of flat parallel ends and three identical vertical sides which extend between the ends, each vertical side possessing at least one continuous vertical groove.

The novel features that are considered characteristic of this invention are set forth with particularity in the appended claims.

BRIEF DESCRIPTION OF THE DRAWINGS

The many objects and advantages of the present invention will become apparent to those skilled in the art when the following description of the best mode contemplated for practicing the invention is read in conjunction with the accompanying drawings, wherein like reference characters refer to the same or similar elements and in which:

FIG. 4A is a top view of a ferrite prism having one groove in each side;

FIG. 4B is a top view of a ferrite prism having a pair of non-symmetrical grooves in each side;

FIG. 4C is a bottom view of a ferrite prism having a pair of semi-circular grooves in each side;

FIG. 4D is a top view of a ferrite prism having three grooves in each side;

FIG. 5 is a graphical representation of experimentally determined dimensions for ferrite prisms intended for operation within the W-band;

DETAILED DESCRIPTION OF THE PREFERRED EMBODIMENT

Figure 1:
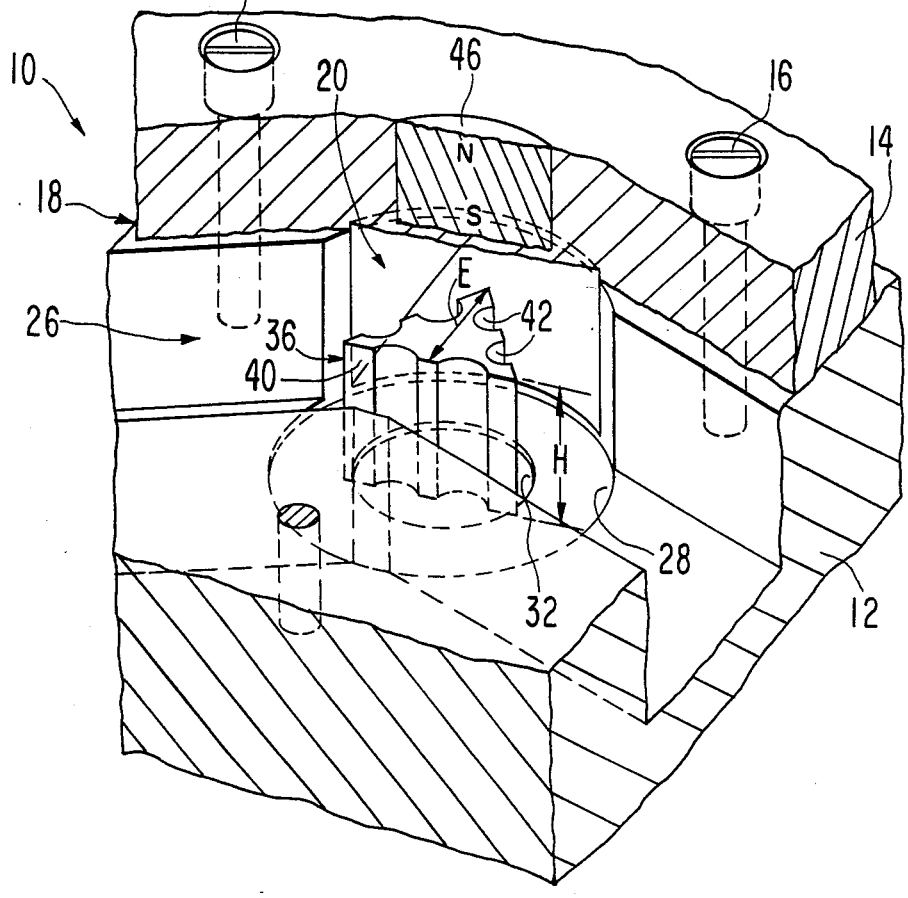
FIG. 1 is a partially broken-away phantom view in perspective of a millimeter wave circulator which possesses a grooved ferrite prism according to the invention.
Figure 2:
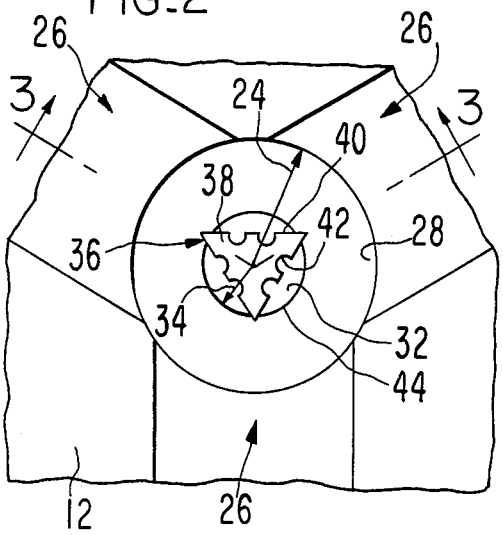
FIG. 2 is a top view of the circulator junction shown in FIG. 1 with the top plate removed to show the placement and alignment of the ferrite prism with respect to the three waveguides.
Figure 3:
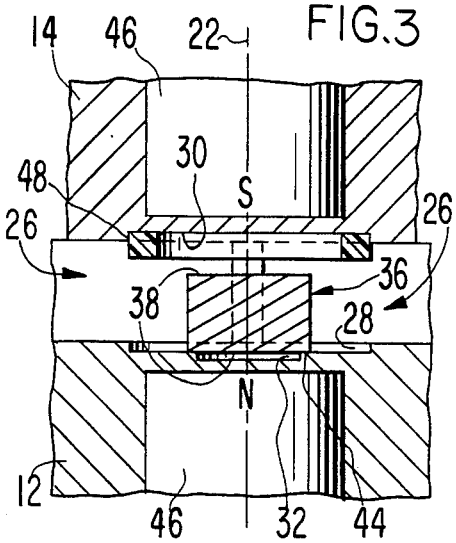
FIG. 3 is a cross-sectional view through the lines 3—3 in FIG. 2 of the circulator in FIG. 1 which includes an optional dielectric ring.

Referring now generally to the several figures and more specifically to FIGS. 1, 2 and 3, there is shown in FIG. 1 a millimeter wave circulator 10 formed by the juxtaposition of a bottom plate 12 and a top plate 14 which are held together with fasteners 16. The resultant assembly forms a housing 18 which possesses a right circular cylindrical cavity 20. The cavity 20 extends about a central vertical axis 22 and has a radius 24 of length R. Three coplanar H-plane waveguides 26 are uniformly disposed around the central vertical axis 22 and are centered between the circular ends of the cylindrical cavity 20. The waveguides 26 may be of conventional construction possessing a height X and a width of 2X. For W-band operation, standard WR-10 size waveguide may be used. WR-10 waveguide is nominally 0.050 inches in height and 0.100 inches wide. The bottom plate 12 and the top plate 14 are electrically conductive and preferably comprise either copper or aluminum. The full height X of the waveguide 26 may be machined in the bottom plate 12, as shown in FIGS. 1 and 3, using conventional numerically controlled milling equipment. It is to be understood that multiple millimeter wave circulators interconnected by lengths of waveguide may be contained in a single housing 18. The right circulator cylindrical cavity 20 has a vertical length L which is greater than the height X of the waveguides 26 and is preferably within the range from 1.1 to 1.3 times the height X. In the embodiment shown in FIGS. 1, 2 and 3, the cylindrical cavity 20 extends vertically into a circular recess 28 in the bottom plate 12 and a circular recess 30 in the top plate 14. Circular recesses 28 and 30 are concentric about the central vertical axis 22 and share the radius 24 of length R which is preferably within the range from 2.2 to 2.6 times the height X.

In the embodiment shown in FIGS. 1, 2 and 3, the circular recess 28 in the bottom plate 12 possesses a concentric circular recess 32 with a depth d and a radius 34 of length r. The length r of radium 34 is preferably within the range from 0.9 to 1.1 times the height X. The depth d of the circular recess 32 is preferably within the range from 0.02 to 0.06 times the height X. In another embodiment (not shown) the concentric circular recess 32 is absent.

A ferrite prism 36 possesses a pair of flat parallel ends 38 between which extend three identical vertical sides. Each vertical side 40 possesses at least one vertical groove 42. The ferrite prism 36 is mounted in the cylindrical cavity 20 with its vertical axis coincident with the central vertical axis 22 and portions of one of the flat parallel ends 38 resting on portions of the rim 44 surrounding the concentric circular recess 32. The three apices of the prism are substantially aligned with the longitudinal center lines of the waveguides 26 as shown in FIG. 2. Precise alignment of, the ferrite prism 36 with the waveguides 26 is not critical. Rotational misalignment (±5°) does not appear to adversely affect circulator performance. This characteristic makes it possible to construct multijunction circulators inwhich each junction does not require individual testing and tuning. The ferrite prism 36 may be permanently mounted to portions of the rim 44 with an epoxy-type adhesive.

Means for statically magnetizing the ferrite prism 36 along the central vertical axis 22 are shown as elements 46 in FIGS. 1 and 3. Those skilled in the art will appreciate that the direction of circulation is determined by the direction of the magnetic field along the central vertical axis 22. Further, it is to be understood that an electromagnet may be employed as means 46 to selectively control the direction of circulation. Although many alternatives will be obvious to those skilled in the art, a single permanent magnet as suggested by the means 46 shown in FIG. 1 or a pair of permanent magnets as suggested by the means 46 shown in FIG. 3, may be effectively employed to accomplish the function of statically magnetizing the ferrite prism 36 along the central vertical axis 22.

An optional dielectric annulus 48 having an exterior radius of length R is shown in FIG. 3 installed in the circular recess 30 in the top plate 14. The dielectric annulus 48 is fabricated from a material such as Rexolite® and functions to narrow the band width and flatten the double ripple isolation function. An annular or ring-like configuration is preferred for simplicity of manufacture and assembly. Only those portions of the dielectric annulus 48 proximate the longitudinal center lines of the waveguides 26 function to fine-tune the performance of the circulator. Similar functional characteristics may be obtained with discrete blocks of Rexolite® cemented to the top plate 14 near the cylindrical cavity 20 and along the longitudinal axis of each waveguide 26.

As mentioned above, the ferrite prism 36 may be embedded in the cylindrical cavity 20 without the need for the concentric circular recess 32. In such an alternative embodiment, the ferrite prism 36 rests on a flat, triangular dielectric spacer of the same equilateral size as the prism (not shown) which is sandwiched between one flat parallel end 38 and the horizontal surface of the circular recess 28 in the bottom plate 12. An epoxy-type adhesive may be used to assemble these elements. The spacer may be fabricated from a material such as Teflon® or Rexolite® and typically has a thickness of from 0.05 to 0.10 times the height X of the waveguides 26. This embodiment is not preferred as it introduces an additional element into the construction, i.e., the dielectric spacer.

In selecting a ferrite material for the ferrite prism 36, the most important characteristic is the saturation magnetization ($4\pi$ Ms) which should be as high as possible. The characteristics of two materials which have about the same $4\pi$ Ms value which are suitable for use in accordance with the invention are as follows:

| Manufacturer | Type | $4\pi$ Ms |
|---|---|---|
| + Countis | C-48 | 5376 |
| * Trans-Tech | TT2-111 | 5000 |

+ Countis Industries 2670 Lockheed Way Carson City, Nevada
* Trans-Tech, Inc. 5520 Adamstown Rd. Adamstown, Maryland 21710

In FIGS. 4A, 4B, 4C and 4D, a selection of various configurations for the ferrite prism 36 of the invention is shown. The three apices of each prism define an equilateral triangle of height E as shown in FIGS. 1 and 4A. The height H of a ferrite prism is the perpendicular distance between the pair of flat parallel ends 38 as shown in FIG. 1. The values for the two dimensions E and H are determined by the frequency range over which the ferrite prism 36 is intended to function. FIG. 5 is a graphical representation of experimentally determined values for the dimensions E and H for ferrite prisms intended for operation within the W-band. The largest values for the dimensions E and H may be determined by scaling for operation at 40 GHz, the lowest frequency at which this invention may have utility. Accordingly, E will always be less than 0.10 inch and H will always be less than 0.09 inch. The height H is preferably within the range from 0.8 to 1.0 times the height E.

The geometry of the ferrite prism 36 has an overriding influence on circulator performance. In particular, it appears that the intensity and frequency location of spurious modes is solely a function of the geometry of the ferrite prism and is not related to the embedding of the prism into the junction environment. It also appears that changing the aspect ratio of the prism (height/-width) does not materially change the location or intensity of the mode spikes relative to the tuned operating band. It appears that the presence and configuration of at least one vertical groove 42 in each vertical side 40 of the ferrite prism 36 is the factor which enables the ferrite prism of the invention to function as desired.

As can be seen in FIGS. 4A, 4B, 4C and 4D, each vertical side 40 is identical with the other two sides on the same ferrite prism 36. It is preferable that each side 40 be symmetrical about a plane which passes through the vertical center line of the ferrite prism 36 and the apex of the prism opposite the side. Such a plane is normal to that vertical side 40 of the prism. All of the configurations for prisms shown in FIGS. 4A, 4B, 4C and 4D have vertical sides 40 which are symmetrical about a plane through the center line of the prism and normal to the vertical side. Each vertical groove 42 may be symmetrical about a selected vertical plane normal to the vertical side 40 in which, the groove 42 is disposed as is shown in FIGS. 4A, and 4C. Each groove may also be asymmetrical about every vertical plane normal to the surface in which the groove is disposed as shown in FIG. 4B. Alternatively, the vertical grooves 42 on a specific ferrite prism 36 may be both symmetrical and asymmetrical as is shown in FIG. 4D. FIG. 4C is a bottom view of a ferrite prism having a pair of semi-circular grooves 42 in each side. Apical portions 50 of the end 38 have been metallized so as to allow the ferrite prism 36 to be soldered to portions of the rim 44 surrounding the concentric circular recess 32 as shown in FIG. 2.

Figure 6:
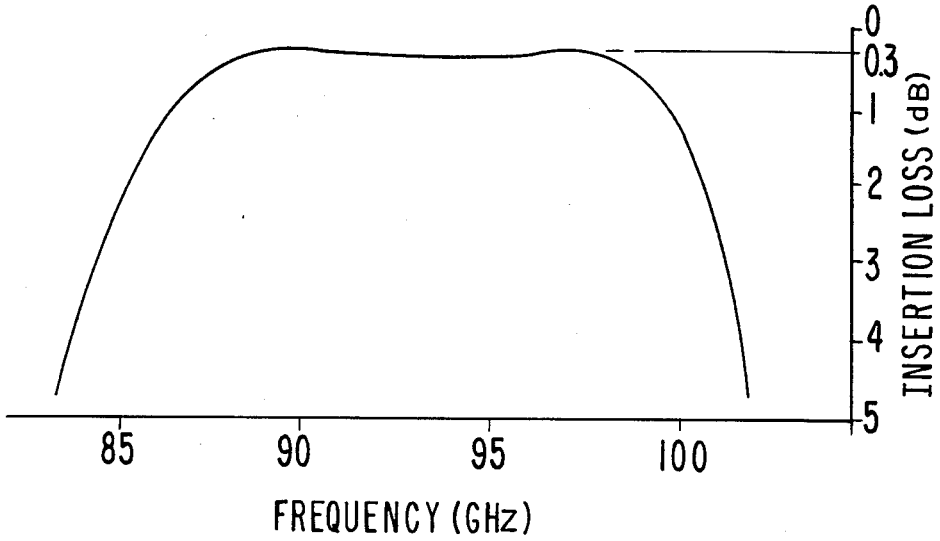
FIG. 6 is a graphical representation of experimental data measured on a circulator made in accordance with the invention showing insertional loss as a function of frequency.
Figure 7:
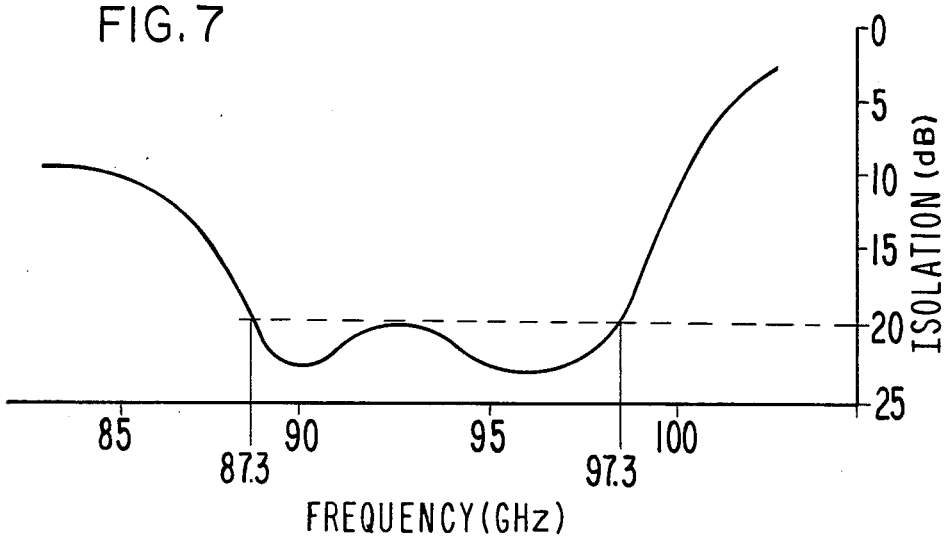
FIG. 7 is a graphical representation of experimental data which shows isolation as a function of frequency as measured on the same circulator used for the data shown in FIG. 6.

FIGS. 6 and 7 provide a graphical representation of experimental data measured on a circulator made in accordance with the invention and show respectively insertion loss and isolation as a function of frequency. As can be seen, both functions are generally smooth and continue to exhibit the familiar double ripple response associated with a pair of closely-spaced higher order resonant mode sets. This test data was measured on a circulator which employed the concentric circular recess 32 and did not use the optional dielectric annulus 48.

From the foregoing detailed description, it will be evident that there are a number of changes, adaptations and modification of the present invention which come within the province of those skilled in the art; however, it is intended that all such variations not departing from the spirit of the invention be considered as within the scope thereof as limited solely by the appended claims.

What is claimed is:

1. A broadband waveguide Y-junction millimeter wave circulator comprising:

a statically magnetized ferrite prism possessing a pair of flat parllel ends and three identical vertical sides which extend between said ends, said three vertical sides each possessing at least one continuous vertical groove disposed therein.

2. A millimeter wave circulator according to claim 1 wherein each of said three vertical sides on said ferrite prism possess a pair of continuous vertical grooves disposed symmetrically about a plane through the certerline of and normal to said each vertical side.

3. A millimeter wave circulator according to claim 2 wherein each groove of said pair is symmetrical about a selected vertical plane normal to the surface in which said groove is disposed.

4. A millimeter wave circulator according to claim 3 wherein each groove is circular in transverse cross-section.

5. A millimeter wave circulator according to claim 2 wherein each groove is asymetrical about every verticl plane normal to the surface in which said groove is disposed.

6. A millimeter wave circulator according to either claim 1, 2, 3, 4 or 5 in which said ferrite prism is dimensioned to suppress spurious mode resonances in the center and roll-off portions of the bandpass and to support two sets of higher order resonance modes wherein the frequency spacing of said mode sets correspond to the two minima of the isolation function.

7. A millimeter wave circulator comprising:

a housing containing a right circular cylindrical cavity extending about a central vertical axis;

three coplanar H-plane waveguides uniformly spaced around said central vertical axis to form a Y-junction;

a concentric circular recess disposed in one circular inside surface of said cavity forming a surrounding rim thereof;

a ferrite prism possessing three identical vertical sides extending between a pair of parallel end surfaces, each of said three vertical sides possessing a pair of vertical grooves disposed symmetrically about a plane through the centerline of and normal to said each vertical side, said ferrite prism centered above said concentric circular recess with portions of one of said pair of end surfaces fixedly mounted to said rim thereof; and means for statically magnetizing said ferrite prism along said central vertical axis.

8. A millimeter wave circulator according to claim additionally comprising:

a dielectric annulus coaxially disposed adjacent the other circular inside surface of said cavity.

9. A millimeter wave circulator comprising:

a housing containing a right circular cylindrical cavity extending about a central vertical axis;

three coplanar H-plane waveguides uniformly spaced around said central vertical axis to form a Y-junction;

a ferrite prism possessing three identical vertical sides extending between a pair of parallel end surfaces, each of said three vertical sides possessing a pair of vertical grooves disposed symmetrically about a plane through the centerline of and normal to said each vertical side, said ferrite prism coaxially disposed along said central vertical axis;

a dielectric spacer possessing parallel end surfaces sandwiched between one circular inside surface of said cavity and one of said pair of end surfaces of said ferrite prism, said dielectric spacer having vertical sides extending between said parallel end surfaces substantially coextensive with said three vertical sides of said ferrite prism; and means for statically magnetizing said ferrite prism along said central vertical axis.

10. A millimeter wave circulator according to claim 9 additionally comprising:

a dielectric annulus coaxially disposed adjacent the other circular inside surface of said cavity.

11. A millimeter wave circulator comprising:

a housing containing a right circular cylindrical cavity of length L and radius R extending about a central vertical axis;

three coplanar H-plane wave guides of height X and width 2X uniformly spaced around said central vertical axis to form a Y-junction;

a concentric circular recess of radius r and depth d disposed in one circular inside surface of said forming a surrounding rim thereof;

a ferrite prism possessing three vertical sides of height H extending between a pair of parallel end surfaces each possessing a set of three apices which define an equilateral triangle of height E, each of said three vertical sides possessing a pair of continuous vertical grooves disposed symmetrically about a plane through the centerline of and normal to said each vertical side, said ferrite prism centered above said concentric circular recess with portions of one of said pair of end surfaces fixedly mounted to said rim thereof; and means for statically magnetizing said ferrite prism along said central vertical axis.

12. A millimeter wave circulator according to claim 11 additionally comprising:

a dielectric annulus of external radius R coaxially disposed adjacent the other circular inside surface of said cavity.

13. A millimeter wave circulator according to claim 11 wherein said means for statically magnetizing said ferrite prism along said central vertical axis comprises:

a pair of spaced-apart permanent magnets mounted to said housing along said central vertical axis outside and at opposite ends of said right circular cylindrical cavity.

14. A millimeter wave circulator according to claim 11 wherein said length L of said right circular cylindrical cavity is preferably within the range from 1.1 to 1.3 times said height X of said H-plane waveguides and wherein said radius R of said right circular cylindrical cavity is preferably within the range from 2.2 to 2.6 times said height X of said H-plane waveguides.

15. A millimeter wave circulator according to claim 14 wherein said radius r of said concentric circular recess is preferably within the range from 0.9 to 1.1 times said height X of said H-plane waveguides and said depth d of said concentric circular recess is preferably within the range from 0.02 to 0.06 times said height X of said H-plane waveguides.

16. A millimeter wave circulator according to claim 15 wherein said height H of said vertical sides on said ferrite prism are preferably within the range from 0.8 to 1.0 times said height E of said equalateral triangle defined by said set of three apices on each of said pair of parallel end surfaces of said ferrite prism.

17. A millimeter wave circulator according to claim 16 wherein said three coplanar H-plane waveguides are WR-10 waveguides with a nominal said height X equal 0.05 inches and a nominal said width 2X equal 0.10 inches.

* * * * *